US008876639B2

(12) United States Patent
Ruvoli

(10) Patent No.: US 8,876,639 B2
(45) Date of Patent: Nov. 4, 2014

(54) SYSTEMS AND DEVICES FOR IMPROVING CATCHING SKILLS

(76) Inventor: Frank Henry Ruvoli, St. John, IN (US)

( * ) Notice: Subject to any disclaimer, the term of this patent is extended or adjusted under 35 U.S.C. 154(b) by 208 days.

(21) Appl. No.: 13/372,051

(22) Filed: Feb. 13, 2012

(65) Prior Publication Data

US 2013/0210559 A1 Aug. 15, 2013

(51) Int. Cl.
*A63B 69/00* (2006.01)

(52) U.S. Cl.
USPC ..... 473/458

(58) Field of Classification Search
USPC ..... 473/458; 128/861; 2/421, 422, 468, 6.6
See application file for complete search history.

(56) References Cited

U.S. PATENT DOCUMENTS

| | | | | | |
|---|---|---|---|---|---|
| 532,567 | A * | 1/1895 | Larwood | 2/421 |
| 2,616,419 | A * | 11/1952 | Karfiol | 602/4 |
| 3,407,809 | A * | 10/1968 | Ross | 128/861 |
| 5,263,916 | A * | 11/1993 | Bobich | 482/124 |
| 5,437,402 | A * | 8/1995 | Ring | 224/159 |
| 5,807,218 | A * | 9/1998 | Nagatomo | 482/124 |
| 5,938,548 | A * | 8/1999 | Upshaw | 473/453 |
| 6,984,184 | B2 * | 1/2006 | Gray | 473/458 |
| 2013/0210559 | A1 * | 8/2013 | Ruvoli | 473/458 |

OTHER PUBLICATIONS

Webpage Download, EpicSports, 2010, www.baseball.epicsports.com/prod/13891/index.html 2 pages.*
Webpage Download, StayingDown, 2003, www.baseball-excellence.com/sbaseballforums/printthread.cfm?Forum=1&Topic=4758, 2 pages.*
Webpage Download, InfoSports, 2004, web.archive.org/web/20040701060239/http://www.infosports.com/baseball/arch/3232.htm, 2 pages.*
Webpage Download, CatchingSkills, 2004, web.archive.org/web/20040102044254/http://members.tripod.com/bb_catchers/catchers/skills_block.htm, 4 pages.*

* cited by examiner

*Primary Examiner* — Gene Kim
*Assistant Examiner* — M Chambers

(57) ABSTRACT

In one embodiment, the first blocking mechanics training system is configured to be worn by a user to develop blocking skills and counter a tendency toward improperly upwardly lifting the chin resulting in a potentially dangerous injury. In one embodiment, the first blocking mechanics training system includes a helmet and a resistance band configured to operatively connect to the helmet and the user. In one embodiment, the second blocking mechanics training system is configured to be worn by a user to develop blocking skills and counter a tendency toward improperly upwardly lifting the throwing hand resulting in a potentially dangerous injury. In one embodiment, the second blocking mechanics training system includes a mitt and a strap having a loop member configured to engage with the user's wrist.

13 Claims, 6 Drawing Sheets

SYSTEMS AND DEVICES FOR IMPROVING CATCHING SKILLS

BACKGROUND

In many sports, the relative position and/or motion of a player is essential in executing a desired athletic movement. Typically, in order to achieve the correct movement, the player must practice. Traditionally, such practice has encompassed repeating the position or movement until it is properly executed. A significant problem with this repetitive practice approach is the player must generally rely on self-inspection to determine whether the motion or position is correct. Endless hours of unknowingly practicing the incorrect motion will input improper data into the player's muscle memory or motor memory and will make it difficult for the player to achieve the intended improvement. A second party observer (e.g., a coach) can sometimes provides insight to correct the motion. This method depends upon the knowledge, communication skills and availability of such an expert observer. A video tape recorder can substitute for an observer. However, using a video recording requires the purchase of costly equipment and often the tape can only be viewed after the practice session has taken place. Thus, corrections would be attempted at a subsequent practice session.

The popularity of baseball or softball among children, teen and adult athletes provides a market whereupon coaches, trainers and the players themselves seek to improve the skills of the players both offensively and defensively. For catchers, catching mechanics are important in a player's progression through the levels of the sport, the ultimate level being Major League Baseball. In baseball, when a pitcher throws a ball in the dirt, it is typically the catcher's job to block and keep the ball in front of the catcher. If a catcher improperly looks up or tilts his or her head upwards, a ball from a pitch in the dirt or a foul ball or even a bat could possibly come up under the catcher's helmet and cause a sever injury. In addition, where a catcher attempts to block a ball thrown in the dirt, a catcher may severely injure his or her thumb by improperly lifting his or her throwing hand which should be placed behind the glove. Methods of improving a catcher's mechanics by focusing on his or her blocking skills and creating a consistency between each block is a frequently sought after goal.

It is desirable to provide players with new types of training systems or training devices that improve the player's catching skills. Accordingly, a need exists for the further development of training devices.

SUMMARY

In one embodiment, a first blocking mechanics training system is configured to be worn by a user to develop blocking skills and counter a tendency toward improperly upwardly lifting the chin resulting in a potentially dangerous injury. In one example, the blocking mechanics training system includes a helmet and a resistance band configured to operatively connect to: (a) the helmet; and (b) the user.

In one example, the resistance band has: (a) a first end configured to operatively connect to the user's first wrist area; and (b) a second end configured to operatively connect to the user's second wrist area.

In one example, the helmet includes one of a two-piece helmet.

In one example, the helmet is a catcher's helmet. In another example, the helmet is a goalie helmet.

In one example, the helmet includes a shell and a facemask.

In one example, the resistance band is removably connected to the helmet. In another example, the resistance band is permanently connected to the helmet.

In one example, the resistance band is configured to operatively connect to the shell. In another example, the resistance band is configured to operatively connect to the facemask.

In one example, the facemask includes a horizontal bar. In one example, the resistance band is connected to the horizontal bar using a clip (e.g., a carabiner clip).

In one example, the resistance band has: (a) a first end connected to a first attachment device which is configured to attach to the user; and (b) a second end connected to a second attachment device which is configured to attach to the user.

In one example, a blocking mechanics training device is configured to be worn by a user to develop blocking skills and counter a tendency toward improperly upwardly lifting the chin resulting in a potentially dangerous injury. In one example, the blocking mechanics training device includes a resistance band configured to operatively connect to: (a) a catcher's helmet; and (b) the user.

In one example, a second blocking mechanics training system is configured to be worn by a user to develop blocking skills and counter a tendency toward improperly upwardly lifting the throwing hand resulting in a potentially dangerous injury. In one example, the second blocking mechanics training system includes a mitt and a strap having a loop member configured to engage with the user's wrist.

In one example, where the strap includes a stopper member and the mitt defines an opening, the strap is operably connected to the mitt by the stopper member being engaged with the opening of the mitt.

In one example, where the mitt defines an opening, the strap is removably connected to the mitt by sliding the loop member through the opening.

Additional features and advantages are described herein, and will be apparent from the following Detailed Description and figures.

DETAILED DESCRIPTION

The training systems and/or training devices disclosed herein may be used to properly train the biomechanical dynamics of a person's desired athletic movement and to aid in the correction of common problems associated with catching.

Figure 1:
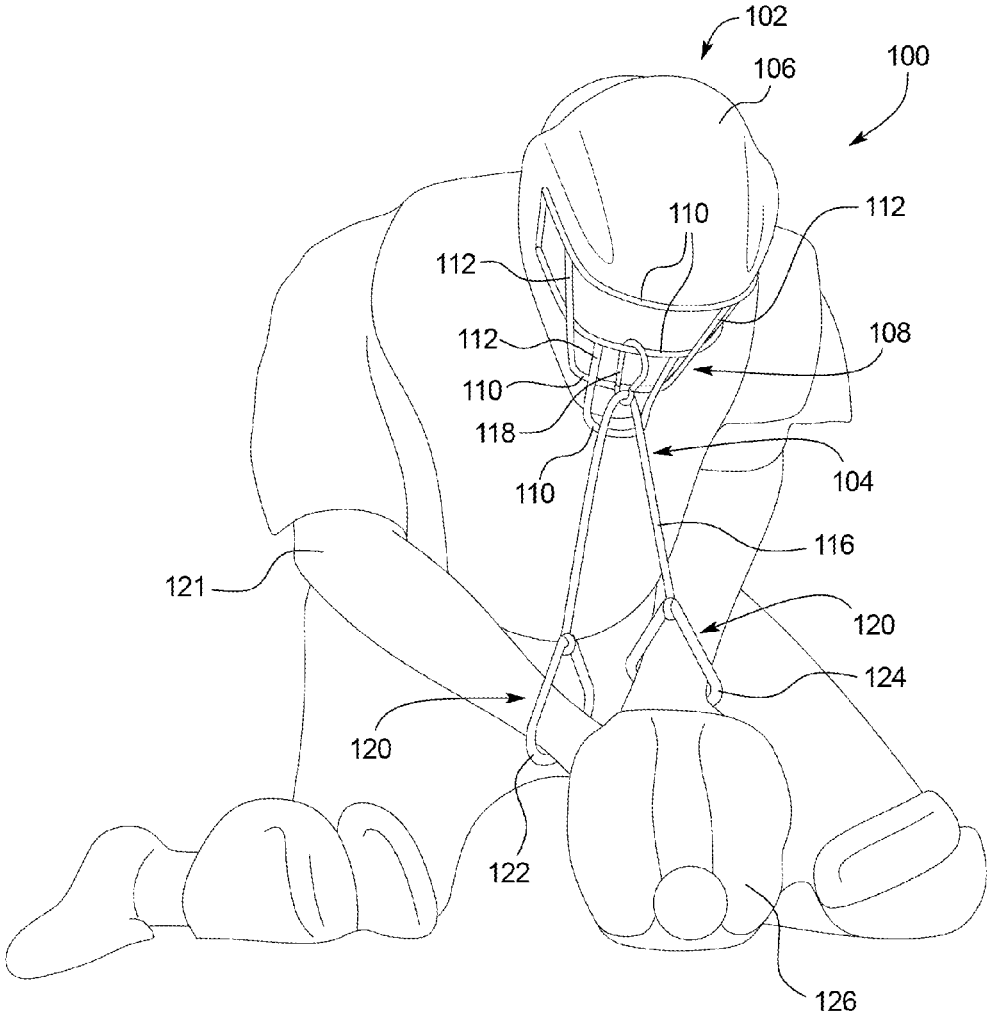
FIG. 1 is front perspective view of one example embodiment of the first blocking mechanics training system disclosed herein, illustrating a user wearing the first blocking mechanics training system.

In one example, the first blocking mechanics training system includes a helmet and a blocking mechanics training device. For example, as illustrated in FIG. 1, first blocking mechanics training system 100 includes helmet 102 and blocking mechanics training device 104.

In one example, helmet 102 includes: (a) shell 106; (b) a padding assembly or head support assembly (not shown); and (c) facemask 108. In this example, shell 106 is a generally hemispherically-shaped head covering, which forms a cranial cavity configured to generally cover and protect the upper portion of a user's head. In one example, the shell has a dome-like crown, a generally continuous circumferential side wall, and ear protective regions. In one example, the crown, side wall, and ear protective regions are molded from a single material source. In one example, certain regions can be formed from separate pieces and integrated with the shell, such as through thermal bonding, adhesive bonding, or other suitable types of bonding known to those skilled in the art.

The shell can be formed of a rigid, durable material, such as, acrylonitrile-butadiene-styrene ("ABS"). In one example, the shell is formed of other materials, such as, for example, a polycarbonate, plastic, aluminum, or other polymers. The shell is configured to protect the user's head by resisting, absorbing and distributing impact loads, such as, for example, the impact from a pitched ball, thereby reducing the load transferred to or felt by the user due to an impact. The padding assembly (not shown) is coupled to an inner surface of the shell and may include a plurality of support members configured to dampen, reduce, absorb, and/or dissipate shock resulting from an impact of the helmet with an object, and reduce the shock transferred to, or felt by, the wearer due to an impact. The padding assembly can be formed of a lightweight, cushionable, resilient material, such as a foam material formed of ethyl vinyl acetate ("EVA foam"), or other open or closed cellular or non-cellular foam, a gel, a fluid-filled bladder, a plurality of spherical balls, a plurality of other geometric objects, or an air-filled bladder.

In this example, facemask 108 includes vertical bars 110 and horizontal bars 112 fitted over, at or near face opening 114 of helmet 102. Facemask 108 is configured to protect a wearer's face without adversely obstructing the wearer's vision or ability to breathe. Vertical bars 110 and horizontal bars 112 can be made of a rigid material, such as, for example, ABS, other high-density polymers, such as Surlyn®, aluminum, composite fiber materials, and combinations thereof. The number, size, shape, and placement of vertical bars 110 and horizontal bars 112 may vary among different example embodiments, as the blocking mechanics training devices described herein are adaptable for use with a wide range of facemask configurations. For example, vertical bars 110 and horizontal bars 112 can be formed in other shapes, such as curved shapes, angled shapes, geometric shapes, irregular shapes and combinations thereof.

Helmet 102 of the FIG. 1 is configured as a catcher's helmet. In other examples, the blocking mechanics training device can be applied to other types of helmets, such as, for example, a goalie helmet.

In one example, the blocking mechanics training device includes: (a) a resistance band; (b) a first connector configured to operably connected to a helmet; and (c) a second connector configured to operably connect to a user of the blocking mechanics training device. For example, as illustrated in FIG. 1, blocking mechanics training device 104 includes: (a) resistance band 116; and (b) connector 118 configured to operably connect to helmet 102; and (c) connector 120 configured to operably connect to user 121.

Resistance band 116 can be made of non-rigid elastic material including but not limited to bungee cord, rubber, or similar elastic polymeric rope-like material.

Resistance band 116 can include an elongated natural or synthetic rubber, or polymeric member. Natural rubber exhibits unique extensibility, in that it possesses the ability to stretch to about six times that of its original un-stretched length. It also correspondingly exhibits excellent resilience by being able to regain its original shape, and excellent tensile strength, meaning the ability to extend under loading without breaking.

In one example, the length of the resistance band can be changed or adjusted. In one example, the length of the resistance band is changed or adjusted based on the size of the user.

Resistance band 116 can have different tension levels. For example, in one embodiment, the resistance band of the blocking mechanics training system can be removed and replaced with another different resistance band having a different level of tension.

As illustrated in FIG. 1, blocking mechanics training device 104 includes connector 118 configured to operably connect to helmet 102. In example, connector 118 includes a clip (e.g., a carabiner clip).

In one example, resistance band 116 is operatively connected to helmet 102 using any suitable device for detachably or permanently attaching objects to one another. In one example, resistance band 116 is connected to helmet 102 using a connector, a fastener, or any other attachment mechanism. In one example, the attachment mechanism is integrally formed in helmet 102. In another example, the attachment mechanism is separate from, and attached to the helmet. In one alternative example, connector 118 is permanently attached to helmet 102.

In one example, resistance band 116 is removably connected to helmet 102 using a buckle. In one example, the buckle includes: (a) a latch plate having an opening; and (b) a latch. In operation, the latch can be inserted into the opening of the latch plate, and thereby be releasably secured therein. In one example, the helmet is connected to the latch plate, and the resistance band is connected to the latch. In another example, the helmet is connected to the latch, and the resistance band is connected to the latch plate.

In one example, resistance band 116 is removably connected to helmet 102 using a hook-and-loop fastener such as, for example, Velcro®.

In one example, resistance band 116 is operatively connected to helmet 102 through an opening of shell 106. In one example, the opening of the helmet is reinforced using a grommet.

In one example, resistance band 116 is operatively connected to helmet 102 using an adhesive.

In one example, blocking mechanics training device includes a first resistance band and a second, separate resistance band. In one example, the first resistance band has a first end having a first connector, and the second resistance band has a second end having a second mating connector. In this example, the blocking mechanics training system includes a helmet including a first connector configured to attach to the connector of the first resistance band; and (b) a second connector configured to attach to the second connector of the second resistance band.

In one example, resistance band 116 is permanently attached to helmet.

In one example, resistance band 116 is operatively connected to the shell. In another example, resistance band 116 is operatively connected to the facemask.

In one example, blocking mechanics training device 104 includes first unitary loop member 122 and second unitary loop member 124. In this example, as illustrated in FIG. 1, when used during a training session, resistance band 116 is operatively attached to user 121 using first unitary loop member 122 and second unitary loop member 124. In this example, user 121 may place his or her hands through first unitary loop member 122 and second unitary loop member 124, with first unitary loop member 122 and second unitary loop member 124 exhibiting elastic qualities to accommodate various sized users.

When used during a training session, resistance band 116 can be operatively attached to the user in a number of different ways. For example, in one embodiment, 116 resistance band has ends (or are attached to devices which have ends) which are configured to operatively attach to the user's forearms. In another example, resistance band 116 has ends (or are attached to devices which have ends) which are configured to operatively attach to the user's wrists. In another example, resistance band 116 has ends (or are attached to devices which have ends) which are configured to operatively attach to the user's hands. In another example, resistance band 116 has ends (or are attached to devices which have ends) which are configured to operatively attach to any suitable combination of the user's forearms, wrists and hands. In one embodiment, the resistance band is connected to only one forearm, wrist, or hand.

In one example, resistance band 116 is configured to be operatively attached to the user using a buckle device similar to the buckle device described above.

In one example, resistance band 116 is configured to operatively couple to user 121 using a hook-and-loop fastener such as, for example, Velcro.

In one example, resistance band 116 is operatively connected to user 121 using attachment devices. In one example, the attachment devices include cinching devices. The cinching devices may be similar to one that is commonly used in clamping up upon drawstrings of outerwear and the like. In one example, the cinching device includes a housing with a clamping member being slidably disposed within a cavity of the housing, and being biased by a spring to have a portion of the clamping member contact the housing. A portion of the clamping member may protrude from the housing to be usable as a button to actuate the clamping member, to permit adjustments to the effective length of the elastic resistance band.

It should be appreciated that resistance band 116 can be configured to operatively attach to the user using any suitable device for detachably attaching objects to one another.

In operation of one embodiment, user 121 puts on helmet 102, then puts their hands through first unitary loop member 122 and second unitary loop member 124 and slides first unitary loop member 122 and second unitary loop member 124 to the forearm. Once properly positioned, user 121 may now put glove 126 on as he or she would ordinarily do, and assume a proper catcher's stance whereby the catcher is ready to catch the ball. Once properly positioned, the catcher is set to begin to move glove 126, seeking to master downward movement of the chin through the correct motion, and striving to be able to do so repetitively. User 121 of the blocking mechanics training system disclosed herein may find advantageous use during practice aimed solely at developing muscle memory, where user 121 has no intention of playing immediately thereafter; or during practice just prior to actually catching in a game, where the catcher removes the training device before his/her actual catching of the ball.

In a properly executed block, the catcher protects his throat and neck by taking his or her chin and tucking it into his or her chest. Where a catcher improperly upwardly lifts their chin during a block, the ball from a foul pitch or from a pitch in the dirt or even a bat can come up under the catcher's helmet and cause a severe injury.

As the catcher begins to place their glove or mitt against their cup with their fingers down, resistance band 116 progressively extends from an un-deflected condition, which may be, for example, roughly nineteen inches in length, depending upon the catcher's height and arm length, and the position at which he/she extends his glove to block the ball.

The blocking mechanics training system can help prevent injuries resulting from a catcher improperly lifting their head. In addition, when a catcher keeps their head in the correct position (i.e., looking down), and when a baseball bounces off the user's mask, the ball will have a better chance to bounce directly down off of the mask, in contrast to bouncing away from the catcher.

When used during a training session, the resistance band can attenuate a catcher's upward head lift thereby teaching the catcher's muscle-memory the feeling of an improper upward head lift or tilt. Where a catcher improperly lifts his or her head, the tension energy loaded into the resistance band as a result of the head lift by virtue of its pulling effect can indicate to a person's muscle-memory that the improper upward head lift occurred.

Figure 2:
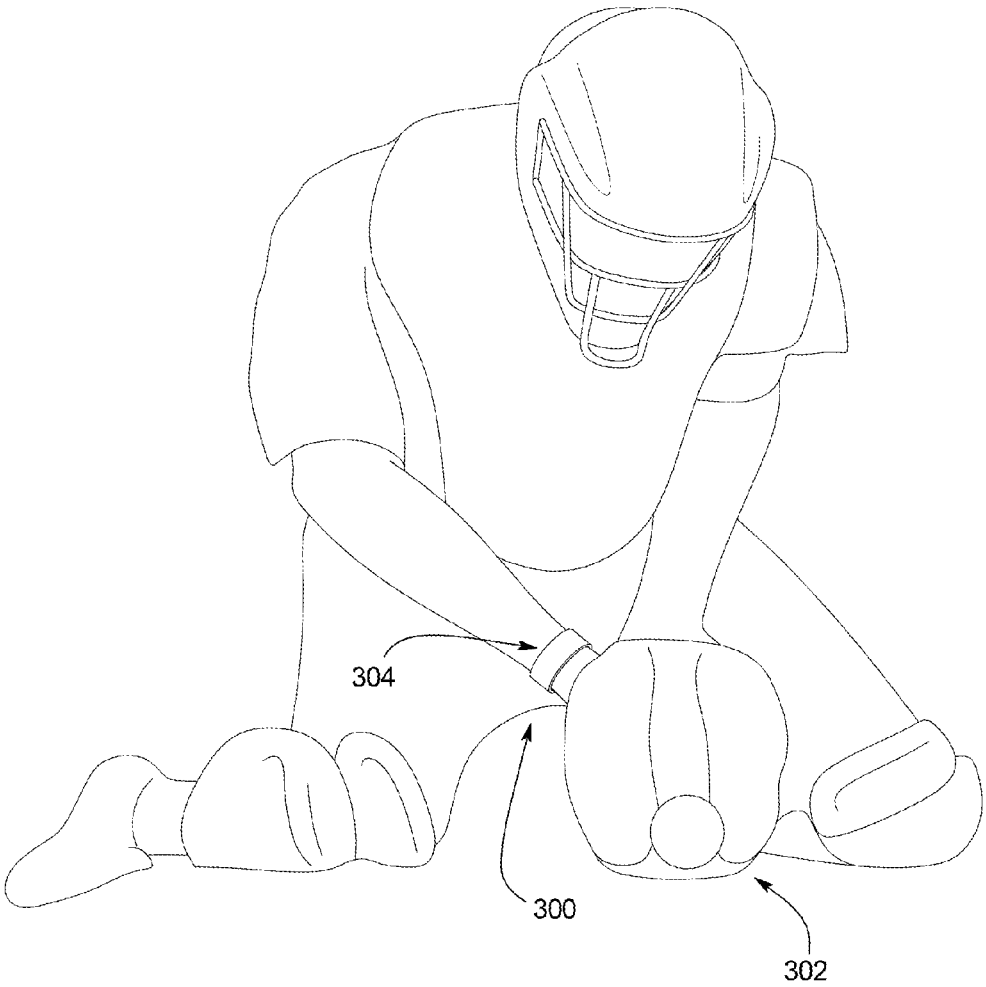
FIG. 2 is a perspective view of one example embodiment of the second blocking mechanics training system discloses herein, illustrating a user wearing the second blocking mechanics training system.
Figure 3:
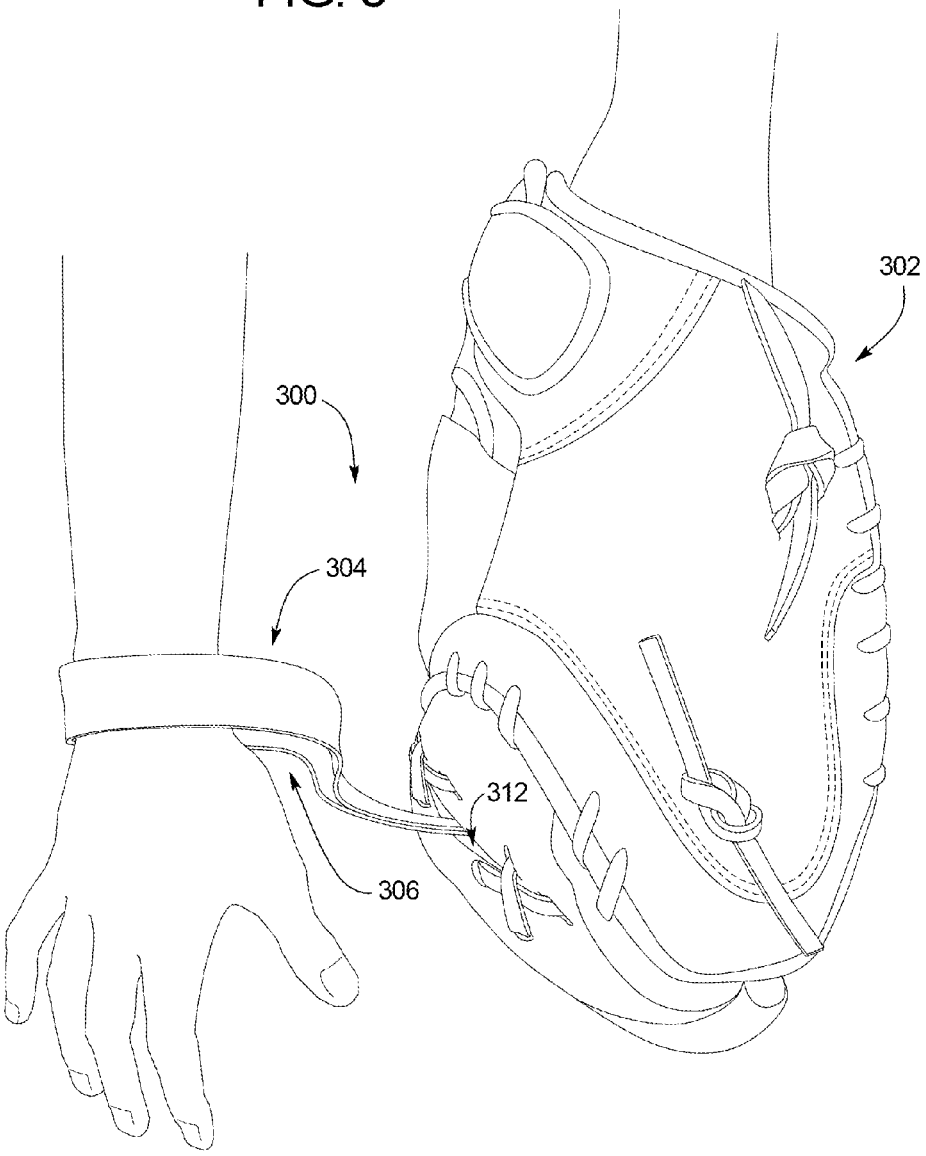
FIG. 3 is a perspective view of one example embodiment of the second blocking mechanics training system disclosed herein, illustrating the strap being engaged with the mitt.
Figure 4:
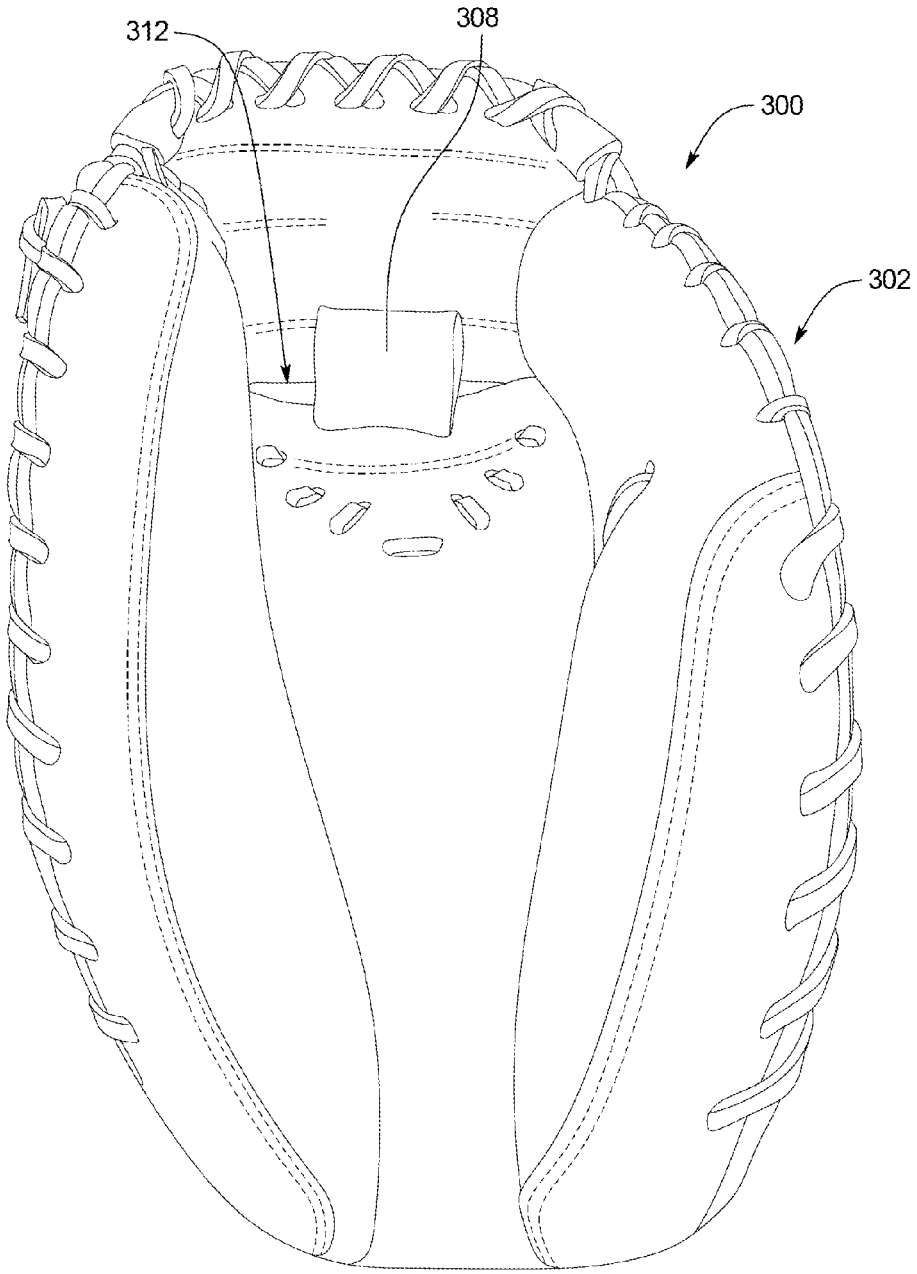
FIG. 4 is a perspective view of one example embodiment of the second blocking mechanics training system, illustrating the stopper member engaged with the mitt.

In one example, the second blocking mechanics training system includes: (a) a mitt or glove; and (b) a strap member which is configured to operably connect the mitt to the user. For example, as best illustrated in FIGS. 2 to 4, second blocking mechanics training system 300 includes: (a) mitt 302; and (b) strap 304.

Figure 5:
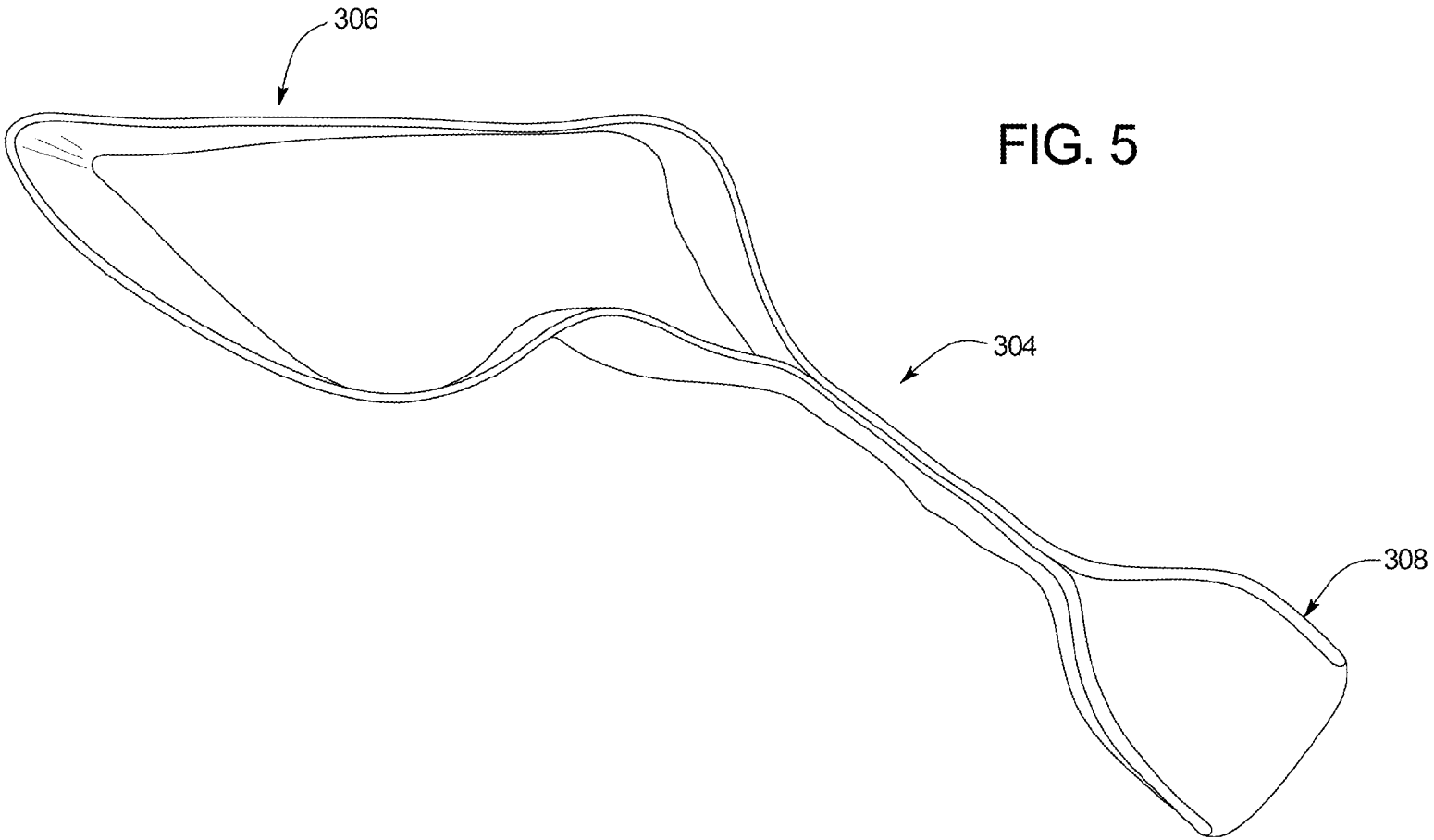
FIG. 5 is a perspective view of one example embodiment of the strap of the second blocking mechanics training system, illustrating the loop member and the stopper member.

In one embodiment, the strap member includes a loop member configured to operably couple the user to the strap member. For example, as illustrated in FIGS. 3 to 5, strap 304 includes: (a) loop member 306; and (b) stopper member 308. In this example, loop member 306 enables strap 304 to connect wrist 310 of the user.

Strap 304 can be made of any suitable material. For example, strap 304 can be made from material which may be a woven nylon, and one or more layers of woven material may be utilized in forming strap 304.

Strap 304 is operatively connected to mitt 302 using any suitable device for detachably or permanently attaching objects to one another. In one embodiment, as best illustrated in FIGS. 3 and 4, strap 304 is operably connected to mitt 302. More specifically, loop member 306 of strap 304 is inserted through opening or hole 312 of mitt 302. Once stopper member 308 makes contact and engages mitt 302, stopper member 308 prevents the entire trap 304 from sliding through hole 312.

Figure 6:
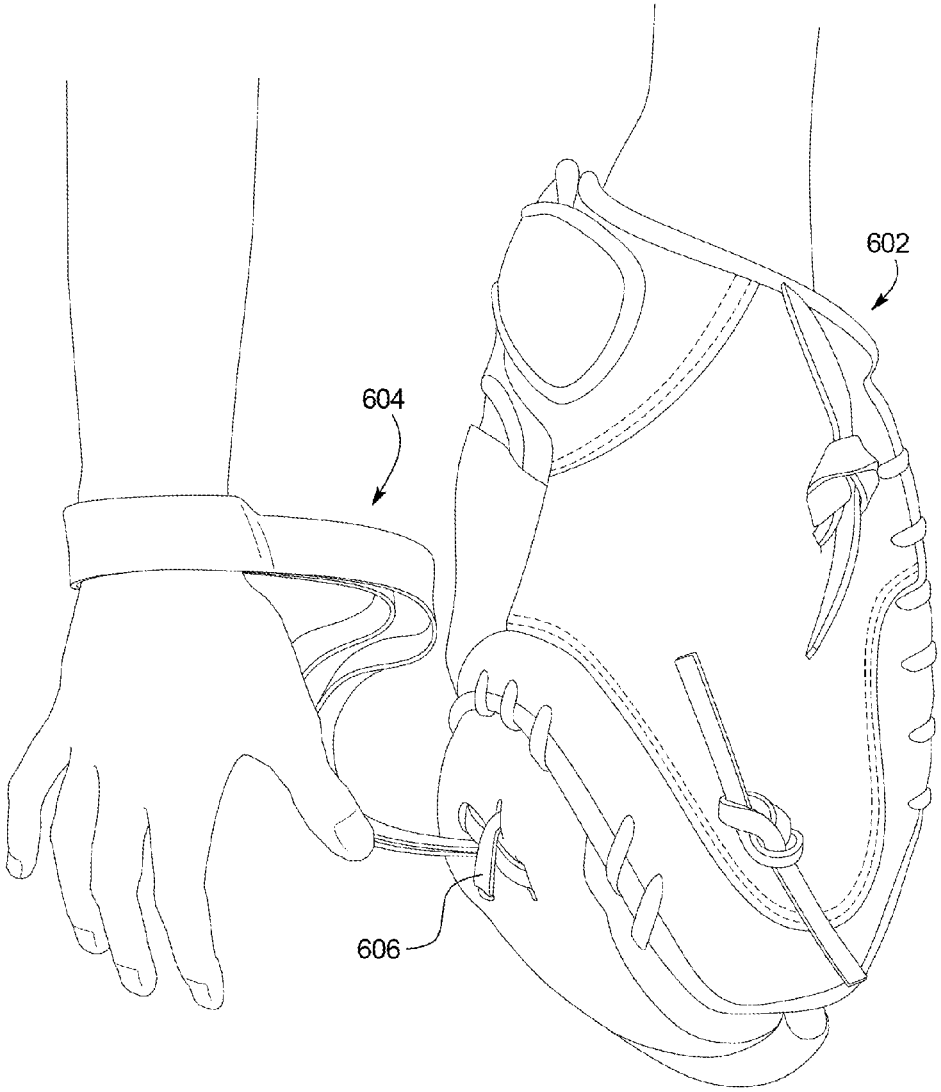
FIG. 6 is a perspective view of one example embodiment of the second blocking mechanics training system, illustrating the strap being stitched to the mitt.

In one example, strap 304 is connected to mitt 302 using a connector, a fastener, or any other attachment mechanism. In one example, the attachment mechanism is integrally formed in mitt 302. In another example, the attachment mechanism is separate from, and attached to mitt 302. In one alternative example, the attachment mechanism is permanently attached to mitt 302. For example, as illustrated in the blocking mechanics training system of FIG. 6, using stitch 606, strap 604 is permanently attached to mitt 602.

In one example, strap 304 is removably connected to mitt 302 using a buckle, such as the buckle device described above.

In one example, strap 304 is removably connected to mitt 302 using a hook-and-loop fastener such as, for example, Velcro®.

In one example, strap 304 is operably connected to mitt 302 using a ball and hinge device.

In one example, strap 304 is operatively connected to mitt 302 through an opening of strap 304. In one example, the opening of the mitt is reinforced using a grommet.

In one example, strap 304 is operatively connected to mitt 302 using an adhesive.

In one example, strap 304 is permanently attached to mitt 302.

In one example, strap 304 is removably connected to mitt 302 using a buckle device similar to the buckle device described herein. In one embodiment strap 304 may have a first end and a second end that are secured together by a securing means such as Velcro.

In one example, strap 304 is configured to be operatively attached to the user using a buckle device similar to the buckle device described above.

In one example, strap 304 is configured to operatively couple to the user using a hook-and-loop fastener such as, for example, Velcro®.

In one example, strap 304 is operatively connected to the user using attachment devices, such as the attachment devices described above.

It should be appreciated that strap 304 can be configured to operatively attach to the user using any suitable device for detachably attaching objects to one another.

In one example operation the second mechanics training system, if the user wears a mitt on his or her left hand, the strap would be positioned to operably connect the user's right wrist area. If the user wears a mitt on his or her right hand, strap 304 would be positioned to connect the user's left wrist area to the mitt. Once properly positioned, the user may assume a proper catcher's stance whereby the catcher is ready to catch the ball. Once properly positioned, in response to a ball be thrown in the dirt or the catcher blocking, the catcher is set to begin to move his or her hands, seeking to master movement of the hands through the correct motion, and striving to be able to do so repetitively. The user of the second blocking mechanics training system may find advantageous use during practice aimed solely at developing muscle memory, where the user has no intention of playing immediately thereafter; or during practice just prior to actually catching in a game, where the catcher removes strap 304 from mitt 302 before his/her actual catching of the ball.

In a properly executed block, the catcher protects his or her hand by proper positioning of his or her throwing hand (i.e., behind the mitt). Where a catcher improperly upwardly lifts and exposes their throwing hand during a block, the ball from a pitch in the dirt can hit the catcher's throwing hand cause a severe injury.

After the catcher properly places their glove against their cup with their fingers down, strap 304 prevents the catcher from improperly upwardly lifting his or her throwing hand, and thereby can prevent injuries resulting the user improperly lifting his or her throwing hand.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A blocking mechanics training system configured to be worn by a user to develop blocking skills and counter a tendency toward improperly upwardly lifting the chin resulting in a potentially dangerous injury, the user having a first wrist area, a second wrist area, a first forearm, and a second forearm, the blocking mechanics training system comprising:

a helmet in combination with a resistance band having:

(a) a portion operatively connected to said helmet;

(b) a first end configured to operatively connect to at least one of the first wrist area or the first forearm; and (c) a second end configured to operatively connect to the second wrist area or the second forearm and wherein (d) the first end of said resistance band is connected to a first attachment device which is configured to attach to at least one of the first wrist area or the first forearm, and (e) the second end of said resistance band is connected to a second attachment device which is configured to attach at least one of the second wrist area or the second forearm of the user.

2. The blocking mechanics training system of claim 1, wherein the helmet includes a shell and a facemask.

3. The blocking mechanics training system of claim 2, wherein the facemask includes a horizontal bar.

4. The blocking mechanics training system of claim 3, wherein the resistance band is connected to the horizontal bar using a clip.

5. The blocking mechanics training system of claim 2, wherein the resistance band is configured to operatively connect to the shell.

6. The blocking mechanics training system of claim 2, wherein the resistance band is configured to operatively connect to the facemask.

7. The blocking mechanics training system of claim 1, wherein the helmet includes one of a two-piece helmet.

8. The blocking mechanics training system of claim 1, wherein the helmet is selected from the group consisting of a catcher helmet and a goalie helmet.

9. The blocking mechanics training system of claim 1, wherein the resistance band is removably connected to the helmet.

10. The blocking mechanics training system of claim 1, wherein the resistance band is permanently connected to the helmet.

11. A blocking mechanics training device configured to be worn by a user to develop blocking skills and counter a tendency toward improperly upwardly lifting the chin resulting in a potentially dangerous injury, the user having a first wrist area a second wrist area, a first forearm, and a second forearm, the blocking mechanics training device in combination with a helmet said training device comprising:

a resistance band having (a) a portion configured to operatively connect to a catcher's helmet;

(b) a first end configured to operatively connect to at least one of the first wrist area and the first forearm; and (c) a second end configured to operatively connect to at least one of the second wrist area and the second forearm and wherein (d) the first end of said resistance band is connected to a first attachment device which is configured to attach to at least one of the first wrist area or the first forearm, and (e) the second end of said resistance band is connected to a second attachment device which is configured to attach at least one of the first wrist area or the first forearm of the user.

12. The blocking mechanics training system of claim 11, wherein the resistance band is configured to operatively connect to a shell of the catcher's helmet.

13. The blocking mechanics training system of claim 11, wherein the resistance band is configured to operatively connect to a facemask of the catcher's helmet.

* * * * *